United States Patent [19]

Wallerand

[11] Patent Number: 4,989,566

[45] Date of Patent: Feb. 5, 1991

[54] THROTTLE MEMBER CONTROL DEVICE FOR AN INTERNAL COMBUSTION ENGINE FUEL SUPPLY INSTALLATION

[75] Inventor: Philippe Wallerand, Sartroville, France

[73] Assignee: Solex, Nanterre Cedex, France

[21] Appl. No.: 429,086

[22] Filed: Oct. 30, 1989

[30] Foreign Application Priority Data

Nov. 25, 1988 [FR] France ..... 88 15446

[51] Int. Cl.[5] ..... F02D 9/10

[52] U.S. Cl. ..... 123/339; 123/339

[58] Field of Search ..... 123/328, 361, 395, 396, 123/399, 403, 339

[56] References Cited

U.S. PATENT DOCUMENTS

| | | | |
|---|---|---|---|
| 4,765,296 | 8/1988 | Ishikawa et al. | 123/399 |
| 4,785,782 | 11/1988 | Tanaka et al. | 123/399 |
| 4,831,985 | 5/1989 | Magee et al. | 123/399 |
| 4,848,505 | 7/1989 | Yoshizawa et al. | 123/396 X |
| 4,879,657 | 11/1989 | Tamura et al. | 123/399 X |
| 4,892,071 | 1/1990 | Asayama | 123/399 X |
| 4,895,343 | 1/1990 | Sato | 123/399 X |

FOREIGN PATENT DOCUMENTS 2072753 10/1981 United Kingdom .

*Primary Examiner*—Willis R. Wolfe

*Attorney, Agent, or Firm*—Larson & Taylor

[57] ABSTRACT

The device controls a throttle member of an induction passage in a fuel supply system. It comprises a first electric sensor for delivering a signal representing the position of a driver actuated member, an electric actuator and a second electric sensor providing an electric signal representing the actual position of the throttle member. The actuator and the sensor are mechanically connected to the throttle member. An electric control circuit receives signals from the sensor and gives the throttle member a position which depends on the position of the driver actuated member. A movable stop is mechanically connected to the driver actuated member and has a one-way connection with the throttle member which limits its degree of opening.

7 Claims, 1 Drawing Sheet

ACTUATOR
COMPUTING CIRCUIT
n
temp. θ
$F_0$
$F_1$

THROTTLE MEMBER CONTROL DEVICE FOR AN INTERNAL COMBUSTION ENGINE FUEL SUPPLY INSTALLATION

BACKGROUND OF THE INVENTION

1. Field of the Invention

The invention relates to fuel supply installations for internal combustion engine and more particularly to a device for controlling the throttle member of the induction passage for such a carburation—or especially injection—installation.

2. Prior Art

At the present time, the tendency is to replace the control devices having a mechanical connection between the throttle member (or butterfly valve) and the control pedal with an electric connection. Devices are in particular known of the type comprising: a first electric sensor (generally a potentiometer) for recopying the position of the member actuated by the driver, an electric actuator and a second electric sensor both connected to the throttle member; and an electric circuit for energizing the actuator, receiving the output signal from the sensors and arranged so as to give the throttle member a position which depends on that of the drive actuated member.

The replacement of a direct mechanical connection with an electric circuit has the advantage of making it possible to make corrections which depend on different operating parameters of the engine, for example its speed and/or its temperature. In particular, it is possible to regulate the position of the throttle member during idling and to absorb the sudden movements of the member drive actuated member.

But most of existing devices have a grave defect: should the actuator fail, there is a danger that the throttle member remains open although the accelerator pedal is released.

SUMMARY OF THE INVENTION

The object of the invention is to provide an improved control device of the above-defined type. It is a more specific object to provide a control device which is free of the above defect while only requiring the use of simple means.

For that, the device comprises a mobile stop for limiting the movement of the throttle member in the opening direction, which is connected to the drive actuated member by the driver by mechanical means.

The one-way connection thus formed prevents the butterfly valve from opening substantially beyond the position defined by the driver and transmitted by the first sensor.

It should be noted that a throttle member control device (British Pat. No. 2,072,753) for carburetors is already known which incorporates a mobile stop. However the stop is not provided for limiting the amount of movement of the throttle member in the opening direction, but for limiting the amount of movement in the closing direction. The throttle member is not controlled by an actuator connected to sensors through an electric circuit. The device described in British Pat. No. 2,072,753 is not designed to attain the result solved by the invention and recalled above and would not make it possible to attain such a result.

Because of the safety thus provided, it is possible to provide an actuator acting in the closure direction of the throttle member, against the force of a return spring which tends to open the throttle member and to bring it into contact with the mobile stop. The torque exerted by this return spring on the throttle member or butterfly valve must always remain less that of the resilient means returning the drive actuated member to the minimum opening position of the throttle member. The effect of the drive actuated member has consequently always priority in the closure direction, which is a safety element.

The choice of these directions of action provides advantages.

In the case of a breakdown resulting in the disappearance of the electric signal controlling the actuator, the throttle member nevertheless follows the position of the accelerator pedal, thus permitting the driver to reach a service station;

if an overvoltage is applied to the actuator for any reason whatsoever, the throttle member is simply applied against the stop defining the minimum degree of opening.

When the drive actuated member is released, the electric actuator can only move the throttle member within a restricted range, so selected as to correspond to the free movement required when regulating idling responsive to the engine load, and to forced partial opening during start-up and cold running when the device does not comprise other circuits coming into play in such situations. When, on the other hand, the drive actuated member is fully depressed, the mobile stop of the device of the invention allows complete opening of the throttle member.

The invention will be better understood from the following description of a particular embodiment by way of non-limitative example.

DETAILED DESCRIPTION OF A PREFERRED EMBODIMENT

Figures 1, 2:
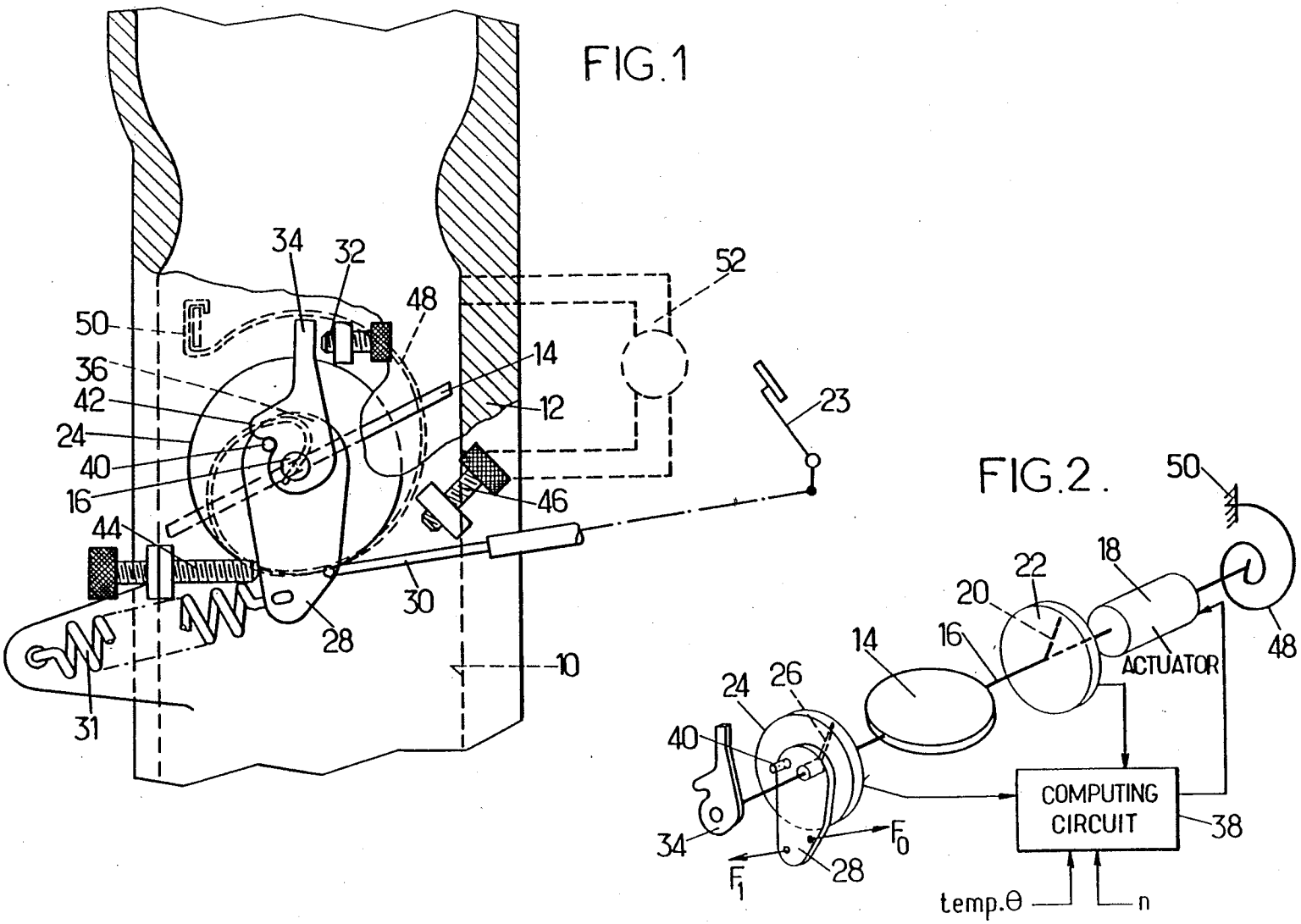
FIG. 1 is an elevational view in partial cross-section of a fraction of the induction passage of an engine and of the control device.
FIG. 2 is a perspective diagram showing the distribution of the components of the device, those of the components which are fast with the throttle member being shown with thick lines.

FIG. 1 shows an induction passage 10 formed in a body 12 which may be the body of a carburetor. In the induction passage is disposed a throttle member 14 formed by a butterfly valve fixed on a shaft 16 which passes through the duct. In an arrangement which is well known per se, the shaft is driven by an actuator 18, shown in FIG. 2 in the form of a rotary actuator, not visible in FIG. 1, and it drives the slider 20 of a sensor detecting the position of the throttle member 14, shown in the form of a rotary potentiometer 22.

The position of the throttle member 14 is controlled by movement of an accelerator pedal 23 which drives the mobile member of an electric position sensor. As shown in FIGS. 1 and 2, the sensor is in the nature of a potentiometer 24. In the illustrated embodiment, the slider 26 of the potentiometer is fast with a lever or finger 28 rotatably mounted about shaft 16 and drivably connected to the pedal 23 by a cable linkage 30 of conventional type. The potentiometer could however be in another position, for example directly along the axis of rotation of pedal 23.

Resilient return means bias the accelerator pedal 23 towards a rest position which is reached when the pedal is not subjected to the action of the driver. The resilient means comprise, in the illustrated embodiment, at least one spring 31 stretched between finger 28 and a fixed anchor point whose action is shown by arrow F1 in FIG. 1. It is preferable to provide two springs placed in parallel relation, so that breakage of a spring does not result in the accelerator pedal assuming a position causing opening of the throttle or butterfly member 14.

To avoid jamming of the throttle member 14 in fully open position, an adjustable stop 32, formed in FIG. 1 by an abutment screw, may be provided. As shown, screw 32 is mounted in a boss of body 12 and cooperates with a stud 34 belonging to a finger 36 fast with shaft 16 and having an other function which will appear further on.

The output signal of potentiometer 24 which "recopies" the position of the accelerator pedal 23, whose action is shown in FIG. 2 by the arrow $F_0$, delivers a control signal to a computing circuit 38 which generates, from that signal (and possibly from a temperature signal $\theta$ a and speed signal n delivered by sensors not shown), as well as from a servo-loop return signal delivered by potentiometer 22, an electric command applied to the actuator 18.

In the embodiment of the invention shown in FIGS. 1 and 2, a one way connection is provided between the accelerator pedal 23 and the throttle member 14, in the form of an abutment connection between fingers 28 and 36. For this, finger 28 comprises a pin 40 cooperating with a bearing surface 42 provided on finger 36.

The limits of the free movement of finger 28, and so of the accelerator pedal 23, are defined by stop members. They are formed, in the case illustrated on FIG. 1, by screws 44 and 46 which limit respectively the movement of finger 28 in the closing direction and in the opening direction.

Actuator 18 is arranged for moving the butterfly valve 14 in the closure direction. The butterfly valve is urged in the opening direction by a return spring formed, in the embodiment illustrated, by a spiral spring 48 connected shaft 16 and an anchoring projection 50 on body 12. The torque exerted by spring 48 must remain appreciably less than the torque exerted by the spring or springs 31 so that the unit moves in the closure direction in the absence of action on the accelerator pedal 23, even if one of springs 31 is broken. The position of stops 32 and 44 is such that the electric actuator 18 may slightly vary the position of the restriction member 14, when the accelerator pedal 23 is released, either for adjusting the idling speed, in particular responsive to the engine load (for example when an air conditioner is started up), or for making starting possible in very cold weather (for example down to −40° C.) which requires forced opening of the throttle member 14.

When the accelerator pedal 23 is slightly actuated from rest, the abutment pin 40 moves and releases the throttle member 14 which may open under the mutually opposing actions of the actuator 18 and of the return spring 48 until it possibly comes into contact again with the abutment pin 40. Such opening may take place more slowly than in a conventional device using a mechanical linkage, according to a strategy stored in the computer 38, which may be of a type known per se.

During deceleration, particularly when the driver desires to use the engine as a brake, releasing the accelerator pedal 23 positively forces the butterfly valve to come back to a low opening position.

The invention is not limited to the particular embodiment which has been described. Numerous modifications are possible. For example, the simply adjustable stop 32 defining the minimum degree of opening of the throttle member 14 may be replaced by a mobile stop, movable by a member responsive either to the temperature of the engine (such as a wax capsule), or to the speed of the engine, or to other parameters. The function of regulating the idling speed may be provided, not by actuator 18, but by a second actuator acting on an air circuit by-passing the butterfly valve, shown schematically in FIG. 1 as a channel 52. The additional air required for cold starting of the engine may be delivered thereto also by such a channel. The stop 44 defining the minimum degree of opening of the accelerator pedal 23 may, in some such cases, be omitted. Finally, the sensors 22 and 24 as well as actuator 18 may of a type different from those which have been shown and, in particular, have a rectilinear rather than a circular motion.

I claim:

1. A device for controlling a throttle member for a fuel supply system of an internal combustion engine, comprising:

first sensor means, operatively connected to a driver actuatable member, for delivering an electrical signal representative of the position of said driver actuatable member;

an electric actuator mechanically connected to the throttle member for moving said throttle member;

second sensor means, mechanically connected to said throttle member, for delivering an electrical signal representative of the position of said throttle member;

an electric control circuit, having inputs connected to receive said electric signals from said first and second sensor means, for energizing said actuator to provide biassing of said throttle member to a position which depends on the position of the driver actuatable member; and movable stop means mechanically connected to the driver actuatable member and limiting the amount of movement of the throttle member in the opening direction;

said driver actuatable member having a rest position so selected as to leave said electric actuator free to move said throttle member within a restricted range, selected to correspond to the amount of movement necessary for the regulation of idling speed responsive to the load of an engine supplied by said fuel supply system and to forced partial opening of the throttle member for starting and cold running.

2. A device according to claim 1, wherein said actuator is constructed to exert a torque on said throttle member in a closing direction thereof, further comprising return spring means biasing the throttle member in the opening direction thereof into abutment with said stop means.

3. A device according to claim 2, further comprising resilient means for biasing the driver actuatable member toward a position corresponding to a minimum opening position of the throttle member and exerting a closing torque greater than that of said return spring means.

4. A device according to claim 3, wherein said throttle member is a rotary butterfly valve and wherein said resilient means are connected to a unit which is mounted for rotation about the axis of said butterfly valve, includes a finger carrying said movable stop means and includes an element whose position determines the electric signal delivered by said first sensor means.

5. A device for controlling a rotary butterfly valve for a fuel supply system for an internal combustion engine, comprising:

first sensor means, operatively connected to a driver actuatable member, for delivering an electrical signal representative of the position of said driver actuatable member;

an electric actuator mechanically connected to the rotary butterfly valve and constructed to exert a torque on said throttle member in a closing direction thereof;

second sensor means, mechanically connected to said rotary butterfly valve, for delivering an electrical signal representative of the position of said rotary butterfly valve;

an electric control circuit, having inputs connected to receive said electric signals from said first and second sensor means, for energizing said actuator to provide biassing of said rotary butterfly valve to a position which depends on the position of the driver actuatable member;

a unit mounted for rotation about the axis of said butterfly valve, including a movable finger carrying stop means, and further including an element the position of which determines the electrical signal delivered by said first sensor means and which is mechanically connected to the driver actuatable member, said stop means limiting the amount of movement of the rotary butterfly valve in the opening direction;

return spring means for biassing the rotary butterfly valve in the opening direction thereof toward abutment with said stop means; and resilient means, connected to said unit, for biassing the driver actuatable member toward a position corresponding to a minimum opening position of the throttle member and exerting a closing torque greater than that of said return spring means.

6. A device according to claim 5, wherein said first sensor means and said second sensor means are respective potentiometers.

7. A device according to claim 5, wherein said driver actuatable member has a rest position so selected as to leave said electric actuator free to move said throttle member within a restricted range, selected to correspond to the amount of movement necessary for the regulation of idling speed responsive to the load of an engine supplied by said fuel supply system and to forced partial opening of the throttle member for starting and cold running.

* * * * *